US009523544B2

(12) United States Patent
Dierks et al.

(10) Patent No.: US 9,523,544 B2
(45) Date of Patent: Dec. 20, 2016

(54) REMOTE GUN CHARGER WITH MANUAL CHARGING RELEASE FUNCTIONALITY

(71) Applicant: Contract Fabrication and Design, Princeton, TX (US)

(72) Inventors: David A. Dierks, McKinney, TX (US); Jesse L. Davison, McKinney, TX (US); M. Damon Serkland, Lavon, TX (US); Jarrett O'Hara, Plano, TX (US); Marvin Vale Riggall, Jr., Nevada, TX (US); Russell D. Mensch, Allen, TX (US)

(73) Assignee: CONTRACT FABRICATION & DESIGN, Princeton, TX (US)

( * ) Notice: Subject to any disclaimer, the term of this patent is extended or adjusted under 35 U.S.C. 154(b) by 0 days.

(21) Appl. No.: 14/857,347

(22) Filed: Sep. 17, 2015

(65) Prior Publication Data

US 2016/0076837 A1 Mar. 17, 2016

Related U.S. Application Data

(60) Provisional application No. 62/051,823, filed on Sep. 17, 2014.

(51) Int. Cl.
*F41A 7/06* (2006.01)

(52) U.S. Cl.
CPC ..... *F41A 7/06* (2013.01)

(58) Field of Classification Search
CPC ..... F41A 7/06; F41A 3/72; F41A 7/04; F41A 7/02; F41A 7/08
USPC ..... 89/1.4, 11, 9, 148
See application file for complete search history.

(56) References Cited

U.S. PATENT DOCUMENTS 2,180,751 A * 11/1939 Wagner ..... F41A 7/06 318/368
2,332,419 A * 10/1943 White ..... F41A 7/04 137/625.68
2,340,705 A * 2/1944 Slate ..... F41A 7/04 89/1.4
2,384,724 A * 9/1945 Chapman ..... F41A 7/06 318/281
2,408,680 A * 10/1946 Pontius ..... F15B 13/02 137/636.4
2,410,767 A * 11/1946 Wisman ..... F41A 7/04 89/1.4
2,411,934 A * 12/1946 Naugler ..... F41A 7/06 89/1.4
2,413,241 A * 12/1946 Mejean ..... F41A 7/06 89/1.4
2,413,416 A * 12/1946 Ostlund ..... F41A 7/06 74/89.23
2,767,615 A * 10/1956 Hardy ..... F41A 7/06 89/1.4

(Continued)

*Primary Examiner* — Joshua Freeman
(74) *Attorney, Agent, or Firm* — Robert C. Klinger

(57) ABSTRACT

A remote gun charger including a charger member configured to selective couple to, and disengage from, a gun having a charger handle configured to charge the gun. The charger includes a catch configured to be positioned by the charger member to selectively position the charger handle and charge the gun. The catch has a first position configured to selectively engage the charger handle, and a second position configured to disengage from the charger handle and allow the gun to be fired.

20 Claims, 11 Drawing Sheets

(56) References Cited

U.S. PATENT DOCUMENTS

| | | | | | |
|---|---|---|---|---|---|
| 2,773,425 | A * | 12/1956 | Weeks | F41A 7/06 | 74/89.35 |
| 2,847,908 | A * | 8/1958 | Boals | F41A 7/04 | 89/1.4 |
| 3,427,925 | A * | 2/1969 | Horn | F41A 7/02 | 89/1.4 |
| 4,966,063 | A * | 10/1990 | Sanderson | F41A 23/00 | 89/1.4 |
| 4,974,499 | A * | 12/1990 | Sanderson | F41A 23/00 | 89/1.4 |
| 8,297,164 | B1 * | 10/2012 | Mensch | F41A 7/06 | 89/1.4 |
| 9,175,914 | B1 * | 11/2015 | Bird | F41A 3/72 | |
| 2005/0262992 | A1 * | 12/2005 | Becker | F41A 7/06 | 89/1.4 |
| 2015/0184958 | A1 * | 7/2015 | Becker | F41A 7/02 | 89/1.4 |
| 2015/0276337 | A1 * | 10/2015 | Crouse | F41A 3/72 | 89/1.4 |
| 2016/0076837 | A1 * | 3/2016 | Dierks | F41A 7/06 | 89/1.4 |
| 2016/0102934 | A1 * | 4/2016 | Davison | F41A 19/59 | 42/69.01 |
| 2016/0109199 | A1 * | 4/2016 | Davison | F41A 3/72 | 89/1.4 |

* cited by examiner

REMOTE GUN CHARGER WITH MANUAL CHARGING RELEASE FUNCTIONALITY

CLAIM OF PRIORITY

This application claims priority under 35 U.S.C. 119(e) of U.S. Provisional Patent Application Ser. No. 62/051,823 entitled Remote Gun Charger with Manual Charging Release Functionality, the teachings of which are included herein in its entirety.

BACKGROUND OF THE DISCLOSURE

The M240 gun is a gas-operated, mechanical weapon. It was designed to be operated by a human holding the weapon, pulling the trigger, and cocking the weapon.

It would be advantageous to place the weapon in a non-manned turret, and remotely operate the gun. It is important that the remote gun charger be able to reliably retract and release the gun cocking stud, and ensure that the remote gun charger cocking mechanism never impedes motion of the gun or the gun charging mechanism. It is important that the remote gun charger be able to cock the gun initially, quickly recock the gun in order to clear a jam, and safe the gun by pulling the cocking stud to the rear and holding it in place thus preventing the gun from firing.

SUMMARY

An electro-mechanical remote gun charger. A remote gun charger mechanism can be manually retracted and locked out of the way of a gun cocking stud (manual override) allowing the gun to fire, and be cocked by a human I the event of a loss of electric power situation. In addition, an auto reset feature is provided such that regardless of operator ignorance, the mechanism will auto reset, meaning the catch will stay forward of the gun cocking stud. In one embodiment, the remote gun charger is configured to operate a M240 gun.

The remote gun charger includes a charger member configured to selective couple to, and disengage from, a gun having a charger handle configured to charge the gun. The charger member includes a catch configured to be positioned by the charger member to selectively position the charger handle and charge the gun. The catch has a first position configured to selectively engage the charger handle, and a second position configured to disengage from the charger handle and allow the gun to be fired.

DETAILED DESCRIPTION OF THE DISCLOSURE

Figure 1:
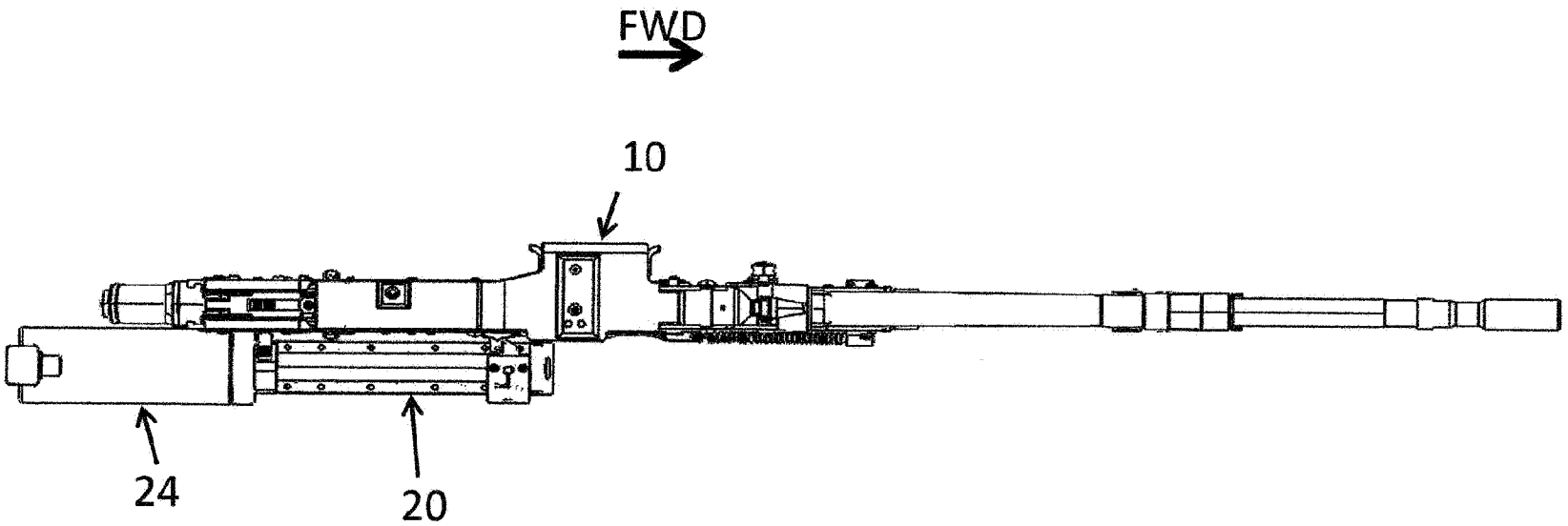
FIG. 1 and FIG. 2 illustrates a weapon comprising a conventional gun, and an electro-mechanical remote charging mechanism configured to charge the gun.
Figure 2:
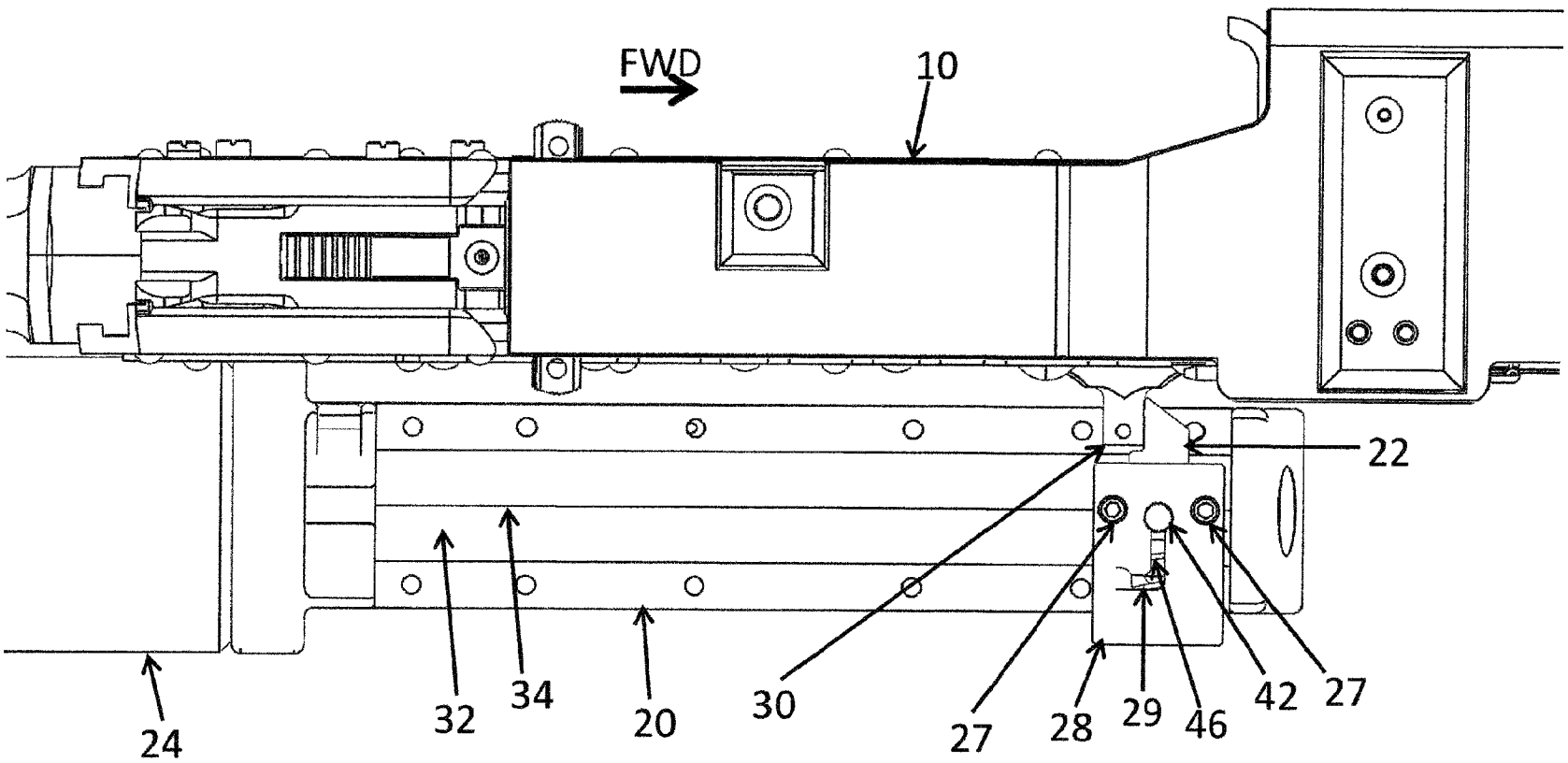

Referring to FIG. 1 and FIG. 2, there is shown a weapon comprising a conventional gun 10, and an electro-mechanical remote charging mechanism 20 configured to charge the gun 10.

The charging mechanism 20 is remote from the gun 10, and is selectively attachable to the gun and also removable therefrom. The gun 10 may comprise an M240 gun for example, but other types of guns configured to be charged are also suitable for use with the charging mechanism 20 according to this disclosure. The charging mechanism 20 has a spring loaded catch 22 configured to selectively engage and longitudinally position a charging handle stud 30 of the gun 10 to charge the gun. FIG. 2 illustrates the catch 22 engaging the charging handle stud 30 in the forward position, and configured to pull the charging handle stud 30 aft.

The charging mechanism 20 is seen to include a positioning mechanism 24, such as a charging motor, coupled to and turning a screw 26 extending parallel to the gun 10. The positioning mechanism 24 may be a mechanical, electrical or pneumatic system. The screw 26 is coupled to a longitudinally movable member 28 by a pair of fasteners 27 coupled between the screw 26 and member 28 such that the member 28 remains upright. Member 28 has an L-shaped slot 29 extending in an upper surface of the member 28. The slot 29 is configured to allow a handle 42 to be manually positioned therein to selectively extend and retract the catch 22, to in turn engage and disengage the charging handle stud 30. A longitudinally extending cover 32 comprising a pair of rubber seals encloses the screw 26 in the charging mechanism 20, and the seals define a slot 34 extending the length of the cover 32.

Figure 3:
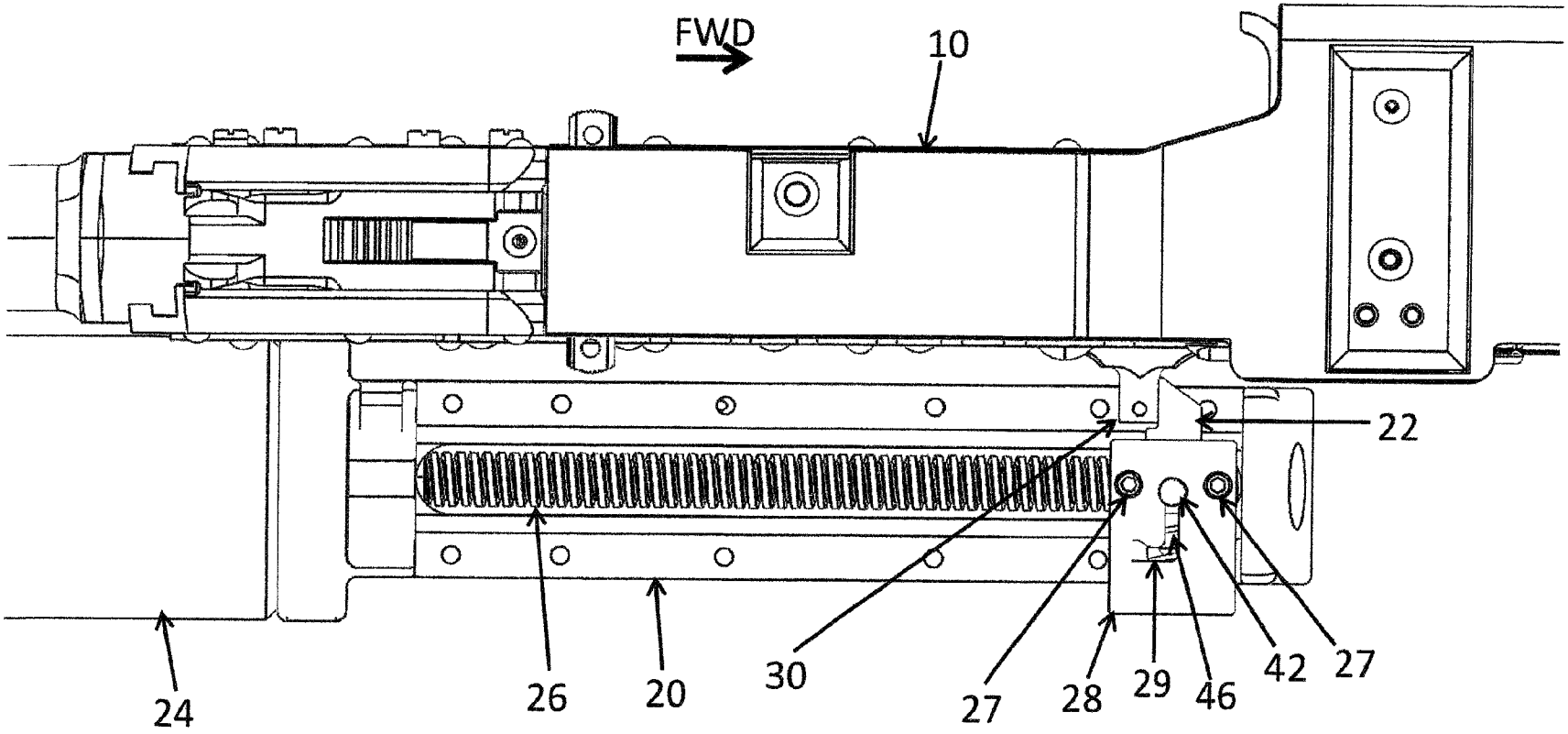
FIG. 3 illustrates the weapon of FIG. 1 with the rubber seals removed to show the screw.

FIG. 3 shows the charging mechanism 20 with the cover 32 removed. The slot 34 allows the fasteners 27 to extend between the seals and be driven by screw 26 along the length of the charging mechanism 20. The charging motor causes rotation of the screw 26 to in turn move the charging catch mechanism including catch 22, member 28, and handle 42 to pull the charging handle stud 30 aft. Charging mechanism 20 can be selectively secured to the gun 10, and selectively removed therefrom as well.

Figure 4:
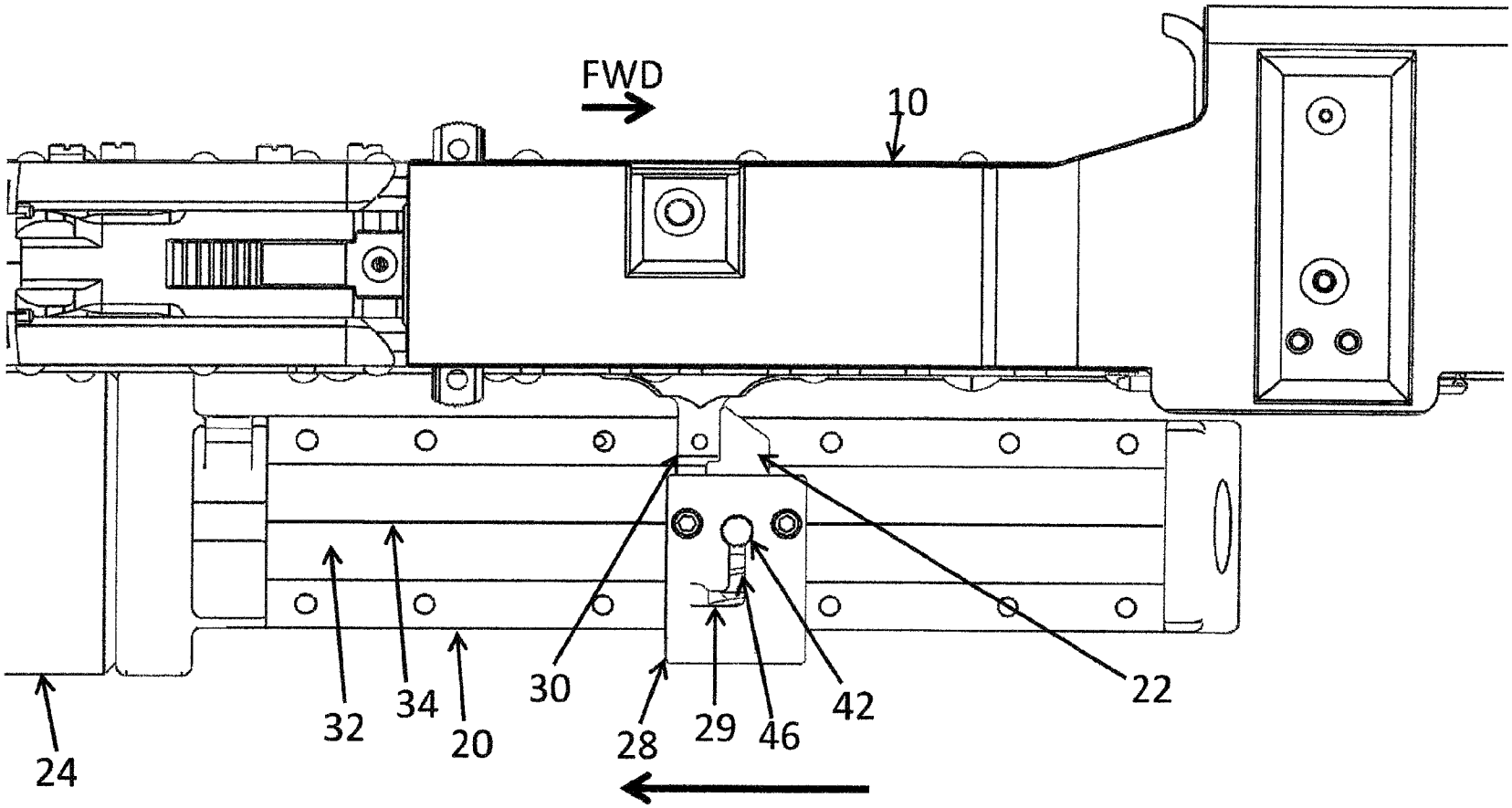
FIG. 4 illustrates a catch pulling the charging handle stud aft to charge the gun.

FIG. 4 shows the catch 22 pulling the charging handle stud 30 aft to charge the gun 10. The charging motor rotates the screw 26 and thus retracts the fasteners 27, member 28 and catch 22, thereby retracting the charging handle stud 30.

Figure 5:
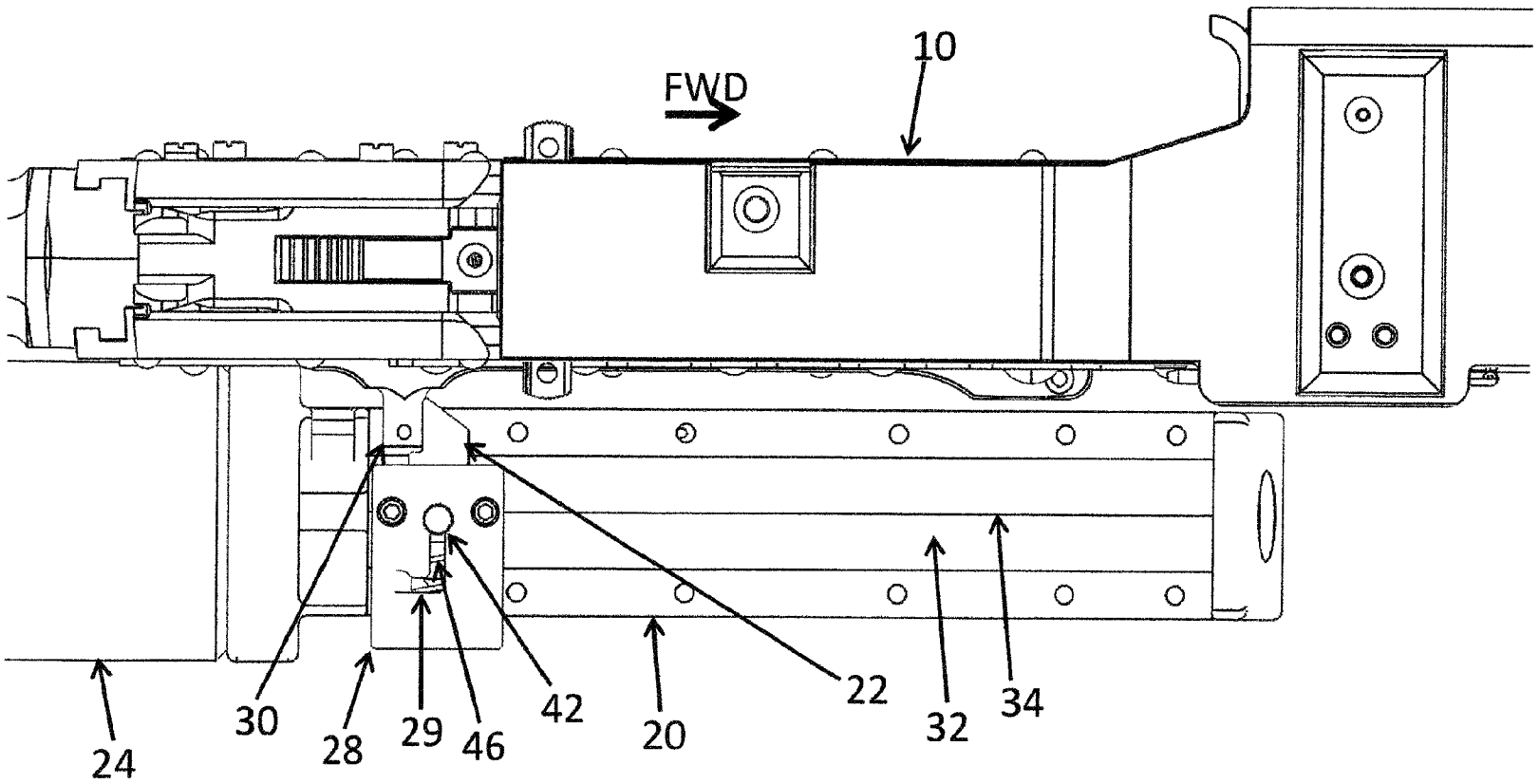
FIG. 5 illustrates the catch with the charging handle stud reaching the aft most position, such that the gun is charged and ready to fire.

FIG. 5 shows the catch 22 with the charging handle stud 30 reaching the aft most position. At this point, the gun 10 is charged.

Figure 6:
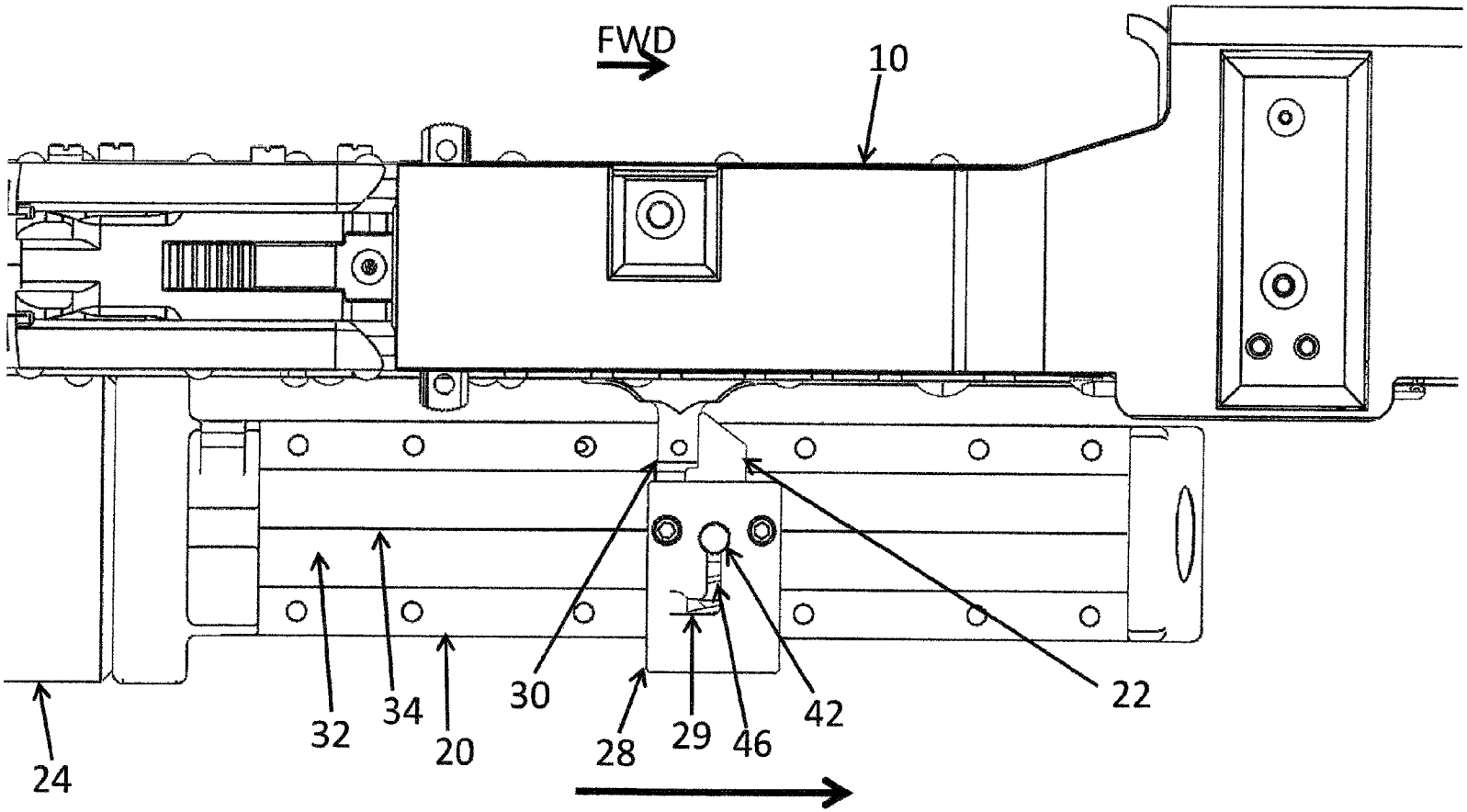
FIG. 6 illustrates the charging mechanism moving the catch forward, along with the charging handle stud, to allow the weapon to fire.

FIG. 6 shows the positioning mechanism 24 moving the catch 22 forward, along with the charging handle stud 30, to allow the weapon 10 to fire. The charging handle stud 30 is biased forward such that it follows the catch 22 as it retracts.

The positioning mechanism 24 automatically moves the catch 22 forward after charging the gun as shown in FIG. 6.

As shown in FIGS. 7-11, the catch 22 can be disengaged from the charging handle stud 30 by using handle 42 to retract catch 22 into member 28, such as to allow independent motion of the charging mechanism 20 and the charging handle stud 30, and also in the situation where there is a loss of electric power for the charging mechanism 24. The catch 22 can be disengaged without removing the charging mechanism 20 from the gun 10. After manually reengaging the catch 22 using handle 42, the catch 22 of charging mechanism 20 automatically resets regardless of the relative position of the charging handle stud 30 and catch 22.

Figure 7:
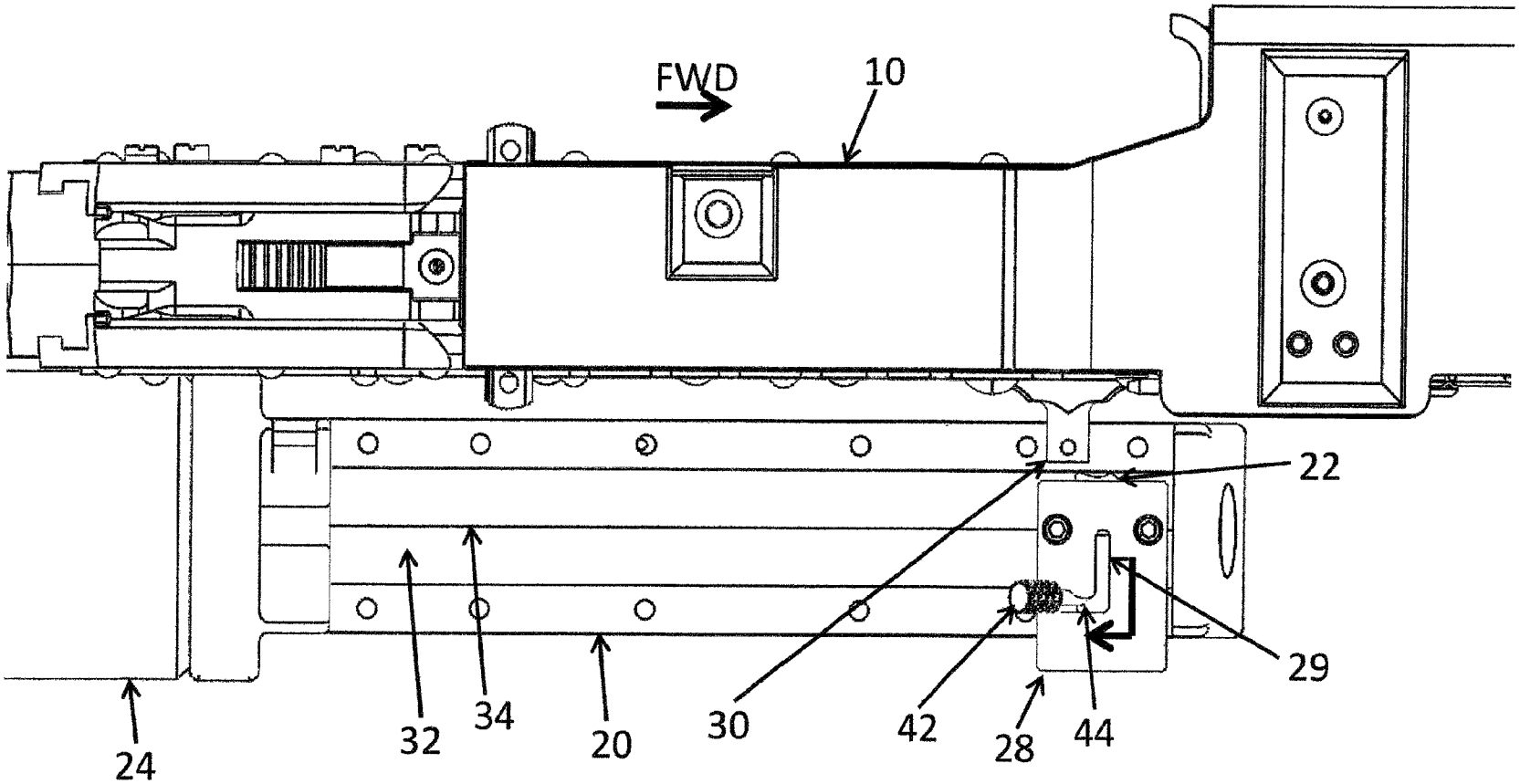
FIG. 7 illustrates the catch manually disengaged from the charging handle stud using handle to retract the catch into the member.

As shown in FIG. 7, the catch 22 is manually disengaged from the charging handle stud 30 using handle 42 to retract the catch 22 into member 28. A spring loaded lever 44 is connected between handle 42 and catch 22 as shown. A spring 46 is configured to urge the lever 44 and catch 22 toward gun 10, yet allows the lever 44 and catch 22 to be manually retracted and locked in the retracted position in the L-shaped slot 29 using handle 42. The gun 10 can now be charged manually when the catch 22 is retracted, free of interference from the charging mechanism 20 and the catch 22.

Figure 8:
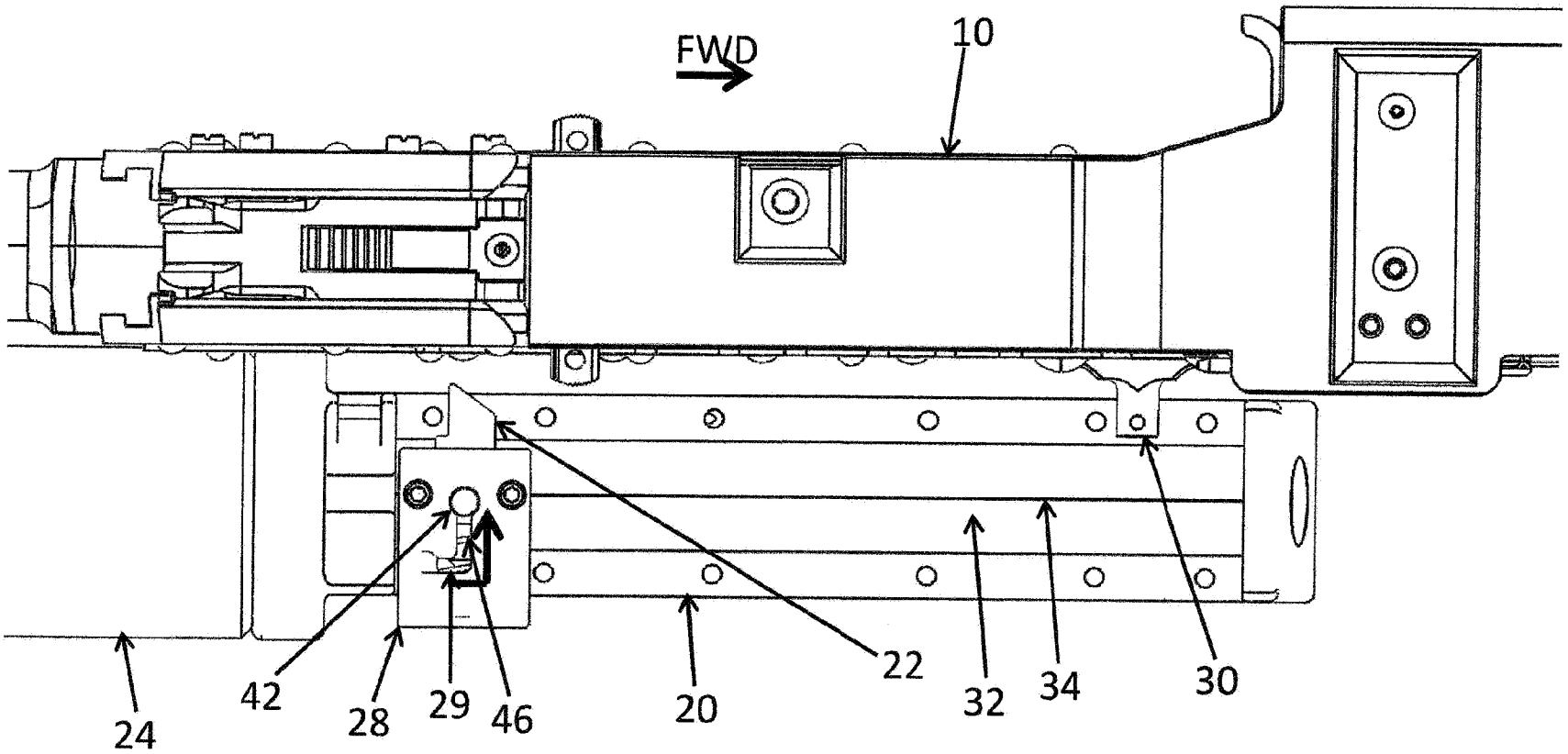
FIG. 8 illustrates the catch can be re-engaged at any position along the gun and along the path of the charging handle stud using the handle.

FIG. 8 shows that the catch 22 can be re-engaged at any position along the gun 10 and along the path of the charging handle stud 30 using handle 42, including when catch 22 is positioned away from charging handle stud 30. The catch 22 is shown re-engaged aft of the charging handle stud 30 in FIG. 8.

Figure 9:
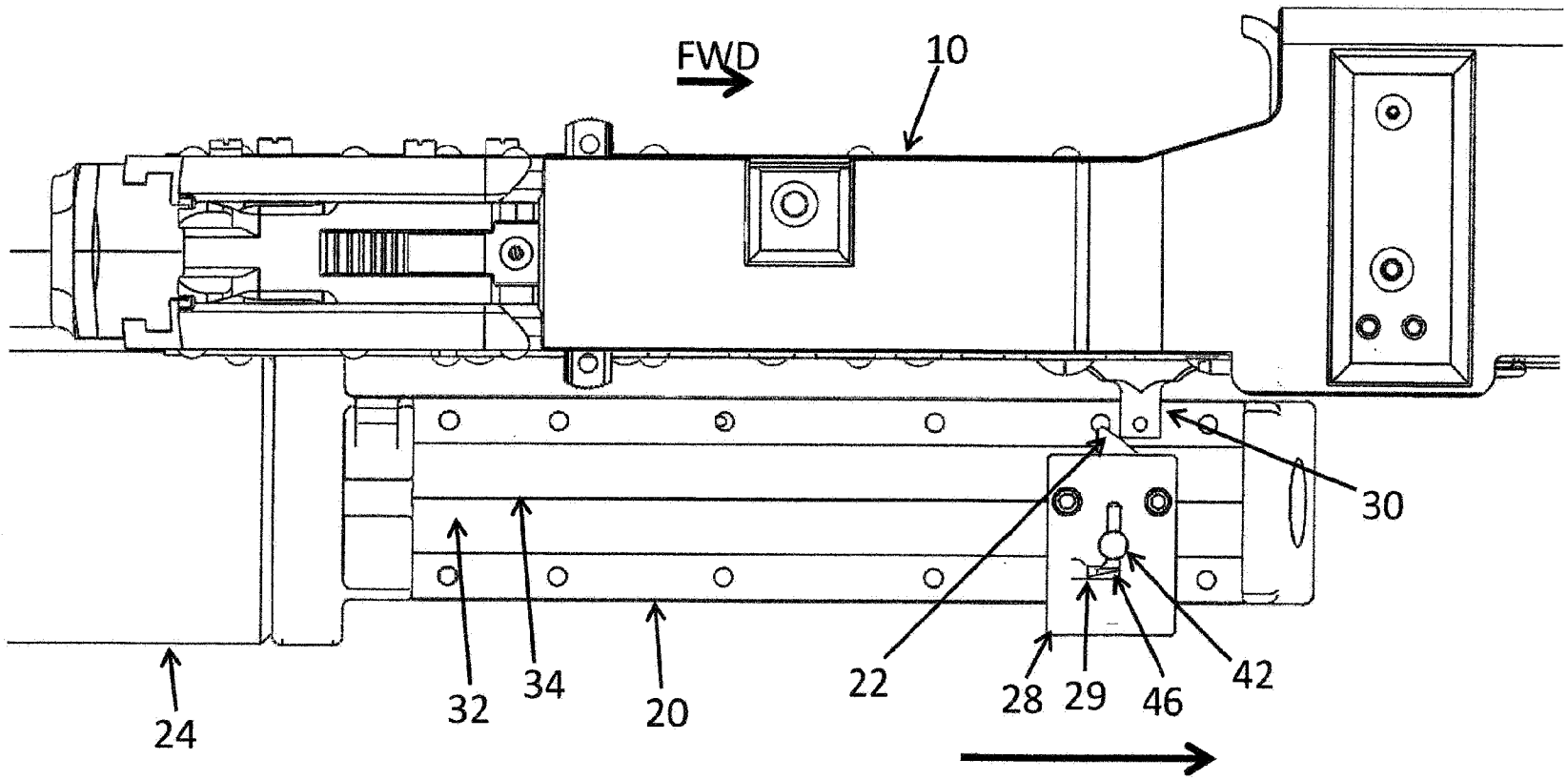
FIG. 9 illustrates the catch traveling forward to find and engage the charging handle stud.

FIG. 9 shows the catch 22 traveling forward to find and engage the charging handle stud 30.

Figure 10:
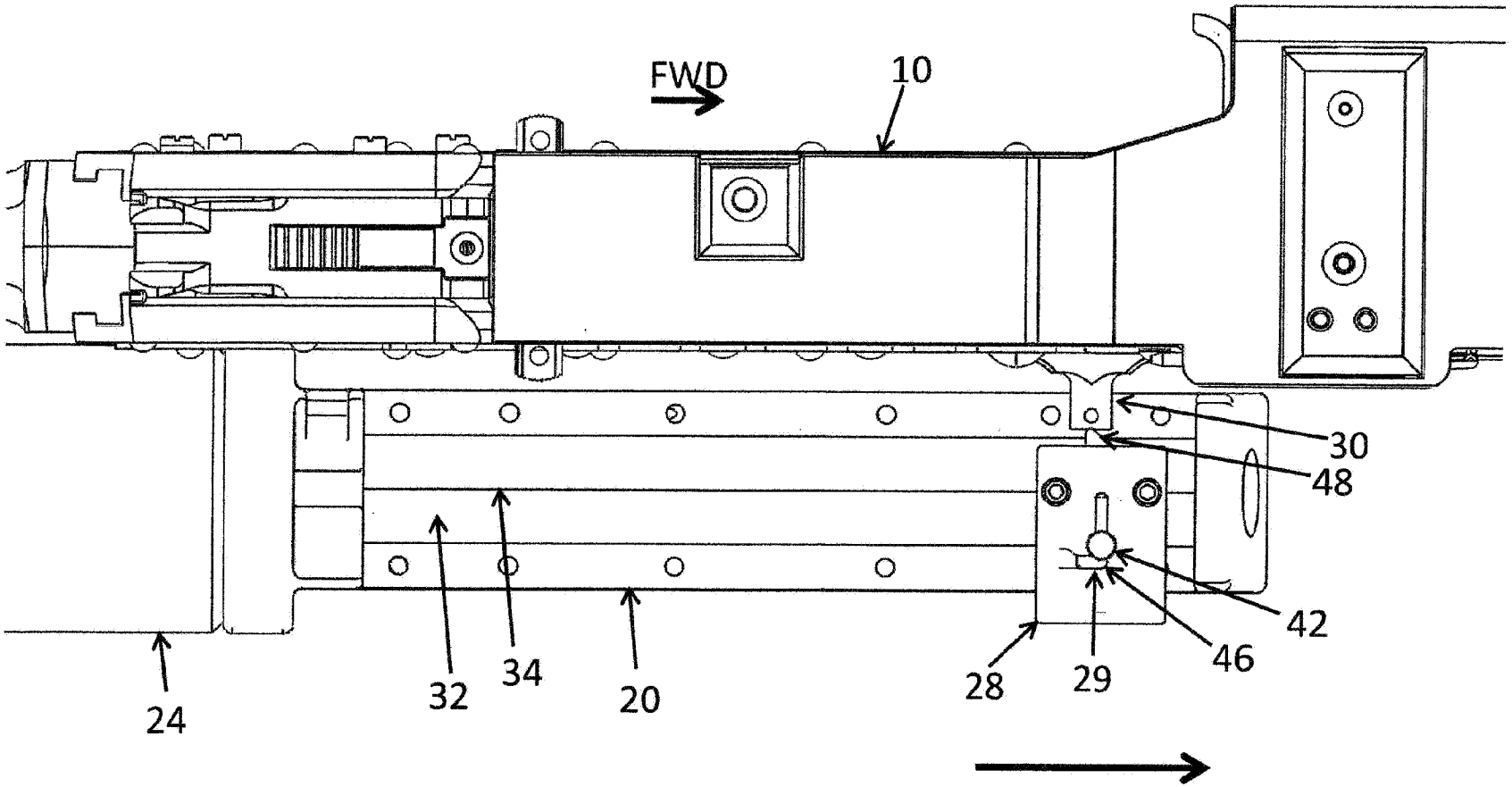
FIG. 10 illustrates the spring loaded catch recessing into member as an angled side of the tip of catch engages and slides past charging handle stud, such that spring compresses.

FIG. 10 shows the spring loaded catch 22 recessing into member 28 as an angled side 48 of the tip of catch 22 engages and slides past charging handle stud 30, such that spring 46 compresses. After the catch 22 slides past the charging handle stud 30, the spring 46 extends the catch 22 behind the charging handle stud 30 to capture the charging handle stud 30, in the same way a door latch captures a strike plate.

Figure 11:
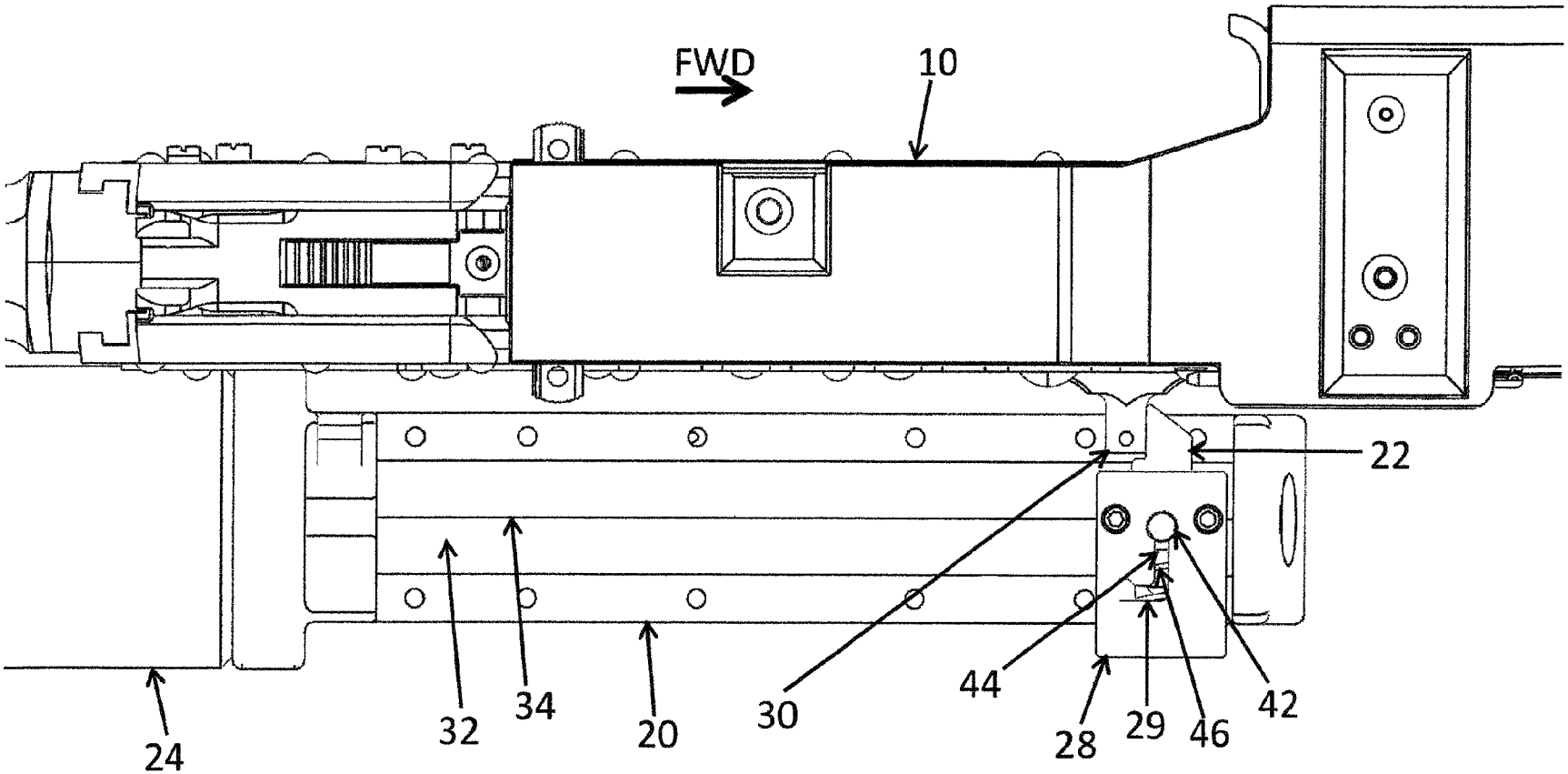
FIG. 11 illustrates the charging mechanism including catch now ready to again remotely charge the gun.

FIG. 11 shows the charging mechanism 20 including catch 22 now ready to again remotely charge the gun 10.

The foregoing detailed description is to be clearly understood as being given by way of illustration and example only, the spirit and scope of the present invention being limited solely by the appended claims.

We claim:

1. A remote gun charger, comprising:

a charger member configured to selective couple to, and disengage from, a gun having a charger handle configured to charge the gun, wherein the charger member comprises:

a catch configured to be positioned by the charger member to selectively position the charger handle and charge the gun;

wherein the catch has a first position configured to selectively engage the charger handle, and a second position configured to disengage from the charger handle and allow the gun to be fired, wherein the catch is configured to be manually moved between the first position and the second position.

2. The remote gun charger as specified in claim 1, wherein the catch includes a spring configured to urge the catch toward the gun.

3. The remote gun charger as specified in claim 1, wherein catch is configured to allow manual operation of the gun.

4. The remote gun charger as specified in claim 3, wherein the catch is configured to automatically reset after being disengaged from the charger handle, wherein the catch has a tip configured to cause the catch to retract as it engages and moves past the charger handle in a rearward direction.

5. The remote gun charger as specified in claim 4, wherein the catch tip has an angled edge.

6. The remote gun charger as specified in claim 5, wherein the tip has a second edge configured to engage and move the charger handle in a forward direction.

7. The remote gun charger as specified in claim 3, wherein the catch can be selectively positioned along the side of the gun without the catch being engaged with the charger handle. configured to engage and move the charger handle in a forward direction.

8. The remote gun charger as specified in claim 7, wherein the catch can be positioned in the first and second position when the catch is positioned in multiple locations along the side of the gun.

9. The remote gun charger as specified in claim 3, wherein the charger member has a displacement member configured to position the catch along the side of the gun.

10. The remote gun charger as specified in claim 9, wherein the displacement member is powered.

11. The remote gun charger as specified in claim 1, wherein the catch has a catch handle configured to manually move the catch between the first position and the second position.

12. The remote gun charger as specified in claim 11, wherein the catch is configured to be locked in the second position.

13. The remote gun charger as specified in claim 12, wherein the catch has a slot receiving the catch handle and configured to lock the catch handle when the catch is in the second position.

14. The remote gun charger as specified in claim 1, wherein the charger member comprises an elongated member extending generally parallel to the gun, and the catch is configured to move along the elongated member and parallel to the gun.

15. The remote gun charger as specified in claim 14, wherein the catch has a tip having an angled edge configured to cause the catch to retract as it engages and moves past the charger handle in a rearward direction, wherein the tip has a second edge configured to engage and move the charger handle in a forward direction.

16. The remote gun charger as specified in claim 15, wherein the catch is configured to be automatically engaged with the charger handle after the gun is fired.

17. The remote gun charger as specified in claim 14, wherein the catch is configured to charge M240 gun.

18. The remote gun charger as specified in claim 17, wherein the elongated member has a slot configured to receive a portion of the catch and allow the catch to slide parallel to the gun.

19. The remote gun charger as specified in claim 17, wherein the elongated member comprises a displacement member configured to position the catch, further comprising a cover configured to enclose the displacement member.

20. The remote gun charger as specified in claim 19, wherein the catch includes a slot member having a slot, and a catch handle movable in the slot configured to position the catch in the first position and the second position.

* * * * *